United States Patent [19]

Sawada et al.

[11] 4,345,120

[45] Aug. 17, 1982

[54] DISTRIBUTOR

[75] Inventors: Hiroji Sawada, Hitachi; Tatsuo Igawa, Kitaibaraki; Hiromitsu Nagae, Katsuta, all of Japan

[73] Assignees: Nissan Motor Company, Limited; Hitachi, Ltd., both of Tokyo, Japan

[21] Appl. No.: 187,139

[22] Filed: Sep. 15, 1980

Related U.S. Application Data

[63] Continuation of Ser. No. 938,363, Aug. 31, 1978, abandoned.

[30] Foreign Application Priority Data

Sep. 2, 1977 [JP] Japan ..... 52-104856

[51] Int. Cl.[3] ..... H01H 19/00

[52] U.S. Cl. ..... 200/19 R; 200/19 DR; 200/19 DC

[58] Field of Search ..... 200/19, 19 DC, 19 DR, 200/267, 270

[56] References Cited

U.S. PATENT DOCUMENTS

| | | | |
|---|---|---|---|
| 3,941,107 | 3/1976 | Rockwell | 200/19 DR X |
| 3,949,721 | 4/1976 | Hori et al. | 200/19 DR X |
| 4,007,342 | 2/1977 | Makino et al. | 200/19 DR X |
| 4,039,787 | 8/1977 | Hori et al. | 200/19 DR X |
| 4,074,090 | 2/1978 | Hayashi et al. | 200/19 DR |
| 4,082,926 | 4/1978 | Marks et al. | 200/19 DR |
| 4,091,245 | 5/1978 | Komiyama et al. | 200/19 DR X |
| 4,135,066 | 1/1979 | Yamanaka et al. | 200/19 DR |
| 4,146,759 | 3/1979 | Watanabe et al. | 200/19 DR X |
| 4,166,201 | 8/1979 | Olander et al. | 200/19 DR |
| 4,217,470 | 8/1980 | Kirner | 200/19 DR X |

*Primary Examiner*—James R. Scott

*Attorney, Agent, or Firm*—Craig and Antonelli

[57] ABSTRACT

A distributor for distributing high-voltage pulses generated by an ignition coil to individual ignition plugs through a center electrode, a rotor electrode and a plurality of side electrodes disposed opposite to the rotor electrode with a discharge gap defined therebetween, in which the discharge-participating area of the rotor electrode and/or each side electrode includes finely interspersed conductive regions and high-resistance regions thereby reducing the discharge voltage at the discharge gap between the rotor electrode and each side electrode for suppressing generation of radio noises. The discharge participating areas of the rotor and stationary electrodes may be formed of ferrite.

6 Claims, 18 Drawing Figures

DISTRIBUTOR

This is a continuation of application Ser. No. 938,363, filed Aug. 31, 1978, now abandoned.

BACKGROUND OF THE INVENTION

This invention relates to a distributor for an internal combustion engine having the function of suppressing generation of radio noises therefrom, and more particularly to a distributor of the kind above described having the function of suppressing generation of a radio noise from the distributor portion between the center electrode and the side electrodes thereof.

As is commonly known, radio noises generating in an ignition system of an internal combustion engine have a wide frequency range and provide a source of disturbance which impairs the otherwise comfortable sense of viewing and listening for the television viewers and radio listeners living in a wide area. As a known means put into practice already for the purpose of suppression of generation of radio noises in such an ignition system, ignition plugs each including a resistor are combined with resistance cord type of ignition cables. This prior art combination is appreciated as being an effective means for the suppression of generation of radio noises from the ignition plugs in the ignition system. However, the ignition plugs in the ignition system are not the sole source of radio noises, and the distributor used for distributing the high-voltage pulses sequentially to the ignition plugs is also another non-negligible source of a radio noise.

For the purpose of minimizing the radio noise generated from the distributor in the ignition system, it has been proposed to incorporate a resistor such as a ceramic resistor in the rotor electrode part of the distributor so as to provide a filter effect against the high-frequency noise components. It has also been proposed to provide a discharge gap of 0.06 to 0.250 inches between the rotor electrode and the side electrodes of the distributor. Various other means have been applied to the portions of the rotor electrode and side electrodes participating in the discharge. However, none of the prior art proposals have been successful in attaining the desired effect of noise suppression.

It is therefore a primary object of the present invention to provide a distributor comprising a novel electrode structure so as to minimize generation of the radio noise from the path of high-voltage pulses between the center electrode and the side electrodes of the distributor.

The distributor according to the present invention is featured by the fact that at least one of the rotor electrode and each side electrode has its discharge-participating area finely divided into interspersed conductive regions and high-resistance regions.

BRIEF DESCRIPTION OF THE DRAWINGS

The above and other objects, features and advantages of the present invention will become more apparent from the following detailed description of preferred embodiments thereof taken in conjunction with the accompanying drawings, in which.

DESCRIPTION OF THE PREFERRED EMBODIMENTS

Figure 1:
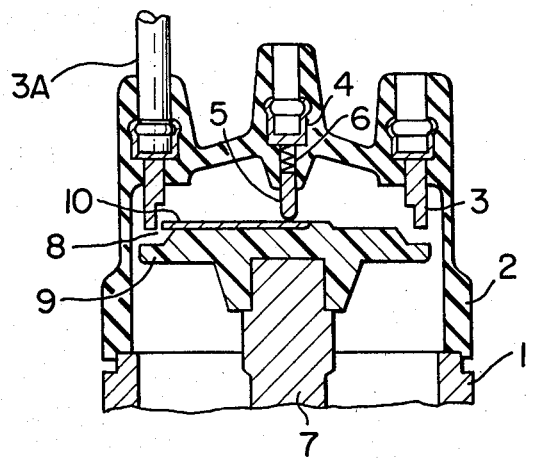
FIG. 1 is a schematic longitudinal sectional view showing the structure of the distributing section of a distributor for an internal combustion engine.

Referring now to FIG. 1 showing the structure of the distributing section of a distributor to which the present invention is applied, the reference numeral 1 designates a housing containing a centrifugal type angle advance unit, a vacuum type angle advance unit or the like, and a rotor shaft 7 extends in the internal space of the housing 1. A rotor head 9 molded from a synthetic resin material such as polypropylene is fixedly mounted on the upper end of the rotor shaft 7 for synchronous rotation with the rotor shaft 7. A rotor electrode 10 is integrally fixed to the upper face of the rotor head 9. A distributor cap 2 covers the open upper end of the housing 1, and a plurality of side electrodes 3 are supported along the inner peripheral wall of the cap 2. Each of these side electrodes 3 is electrically connected at one end thereof to an associated ignition plug by a cable 3A and is disposed at the other end thereof opposite to the rotor electrode 10 through a discharge gap 8. A center electrode 5 is disposed at substantially the center of the cap 2 and is electrically connected at one end thereof to the ignition coil through a conductive spring 6 and a center terminal 4. The center electrode 5 engages at the other end thereof with the rotor electrode 10 so that current can flow from the center electrode 5 to one of the side electrodes 3 via the rotor electrode 10 during ignition in each engine cylinder.

When now the rotor electrode 10 is brought to the position opposite to one of the side electrodes 3 in such a distributor as shown in FIG. 1, the high voltage applied to the center electrode 10 produces spark discharge across the discharge gap 8 due to the dielectric breakdown of air. Simultaneously with the spark discharge, a spark jumps across the associated ignition plug to make the desired igniting operation. Discharge occurring between the rotor electrode 10 and the associated side electrode 3 in concurrent relation with the spark discharge across the associated ignition plug provides the source of the radio noise.

The energy E of this radio noise is given by $$E=\frac{1}{2}CoV^2$$

where Co is the stray electrostatic capacity when viewed from the center electrode 10 and side electrode 3, and V is the discharge voltage at the discharge gap 8. Subsequent to the above discharge, the magnetic energy stored in the ignition coil flows through this discharge gap 8. These two types of discharge can be distinguished from each other. That is, the former is capacitive discharge, while the latter is inductive discharge. It is the capacitive discharge which provides the major source of objectionable radio noise, since its instantaneous energy is quite great. In order to minimize generation of this objectionable radio noise, therefore, the stray electrostatic capacity Co in the aforementioned equation should be decreased or the discharge voltage V at the discharge gap 8 should be reduced. However, a great decrease in the value of Co is difficult since it is a limit determined by the shape, and it will be seen that the appropriate solution is the reduction in the value of V.

The present invention concerns with the reduction in the value of the discharge voltage V at the discharge gap 8. Generally, a discharge voltage at a very narrow gap depends not only on the kind and pressure of the gas occupying the discharge space, but also on the shape and material of the electrodes. It is difficult to employ all of these factors for the long-term maintenance of operating performance of the distributor having such a specific structure.

The inventors have discovered that formation of local high-resistance films on the discharge-participating areas of electrodes spaced apart by a discharge gap can greatly reduce the discharge voltage at the discharge gap. The basic principle will be described with reference to FIG. 2.

Figure 2A:
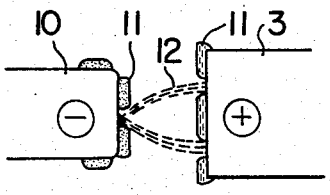
FIGS. 2*a* to 2*c* are diagrammatic views illustrating the basic principle of noise suppression according to the present invention.
Figure 2B:
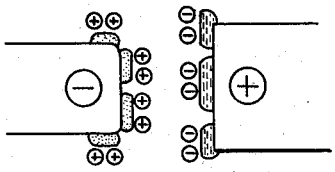
Figure 2C:
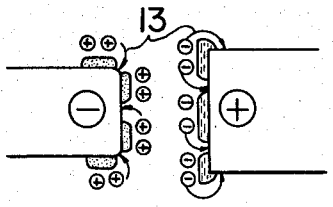

In FIG. 2, the reference numerals 3 and 10 designate electrodes corresponding to the side electrode 3 and rotor electrode 10 respectively. It will be seen in FIG. 2 that local high-resistance films 11 are formed on the opposed areas of these electrodes 3 and 10. Due to the presence of such films 11, initial discharge as shown by the dotted lines 12 in FIG. 2*a* occurs across the discharge gap. Subsequent to termination of the initial discharge, charges of polarities opposite to the applied voltage deposit electrostatically on the surface of the high-resistance films 11 formed on the opposed areas of the electrodes 3 and 10 respectively, as shown in FIG. 2*b*. These charged particles are gas molecules or electrons ionized during the discharge. Then, when, in the state shown in FIG. 2*b*, the high voltage is applied across the electrodes 3 and 10 again in the next cycle with the polarity opposite to the polarities of the charges or space charges depositing on the high-resistance films 11, a strong electric field is produced between the high-resistance films 11 carrying the space charges and the remaining conductive electrode regions in each electrode, and pre-ignition as shown by the arrows 13 occurs in each electrode prior to the occurrence of discharge across the discharge gap between the electrodes 3 and 10, as shown in FIG. 2*c*. It has been clarified that this pre-ignition 13 supplies sufficient amounts of electrons and ions to the discharge gap between the electrodes 3 and 10, and the discharge voltage can be reduced by about 50%.

In FIG. 2, both the electrodes 3 and 10 are shown as having the conductive regions and high-resistance regions in their opposed areas. However, it is apparent that the notable effect is the same even when such high-resistance regions are formed on only one of these electrodes 3 and 10.

The present invention is based on the above principle and provides a distributor comprising an electrode structure having high-resistance regions interspersed with conductive regions on the area opposite to another discharge electrode of similar structure. Preferred embodiments of the present invention will now be described in detail with reference to the drawings.

Embodiment 1

Ferrite is the general name of ferrites of bivalent metal elements M and is expressed by the molecular formula $MFe_2O_4$. The metal elements M include, for example, Fe, Co, Ni, Cu, Mg and Zn. The ferrites of these metal elements are prepared by mechanically mixing oxides, carbonates, oxalates, hydroxides, etc. of these constituent metal elements, and after molding, calcining and firing the mixture to obtain solids. Practical manufacturing processes for these ferrites have already been industrially established, and any especial process or blending of raw materials is not required for the realization of the present embodiment.

Such a ferrite is semiconductive, and its structure is most analogous to the structure shown in FIG. 2 illustrating the basic principle of the present invention. That is, local high-resistance regions are interspersed with conductive regions in the ferrite. For example, the volume resistivity of single crystals of $Fe_3O_4$ is about $10^{-2}$ Ω-cm, whereas those of NiO and MnO are about $10^8$ Ω-cm and $10^9$ Ω-cm respectively.

Figure 3:
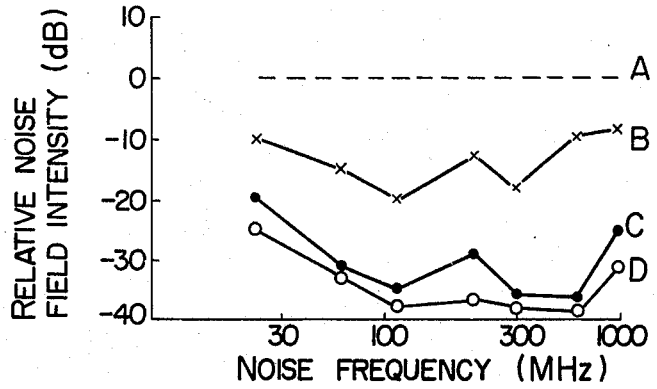
FIG. 3 is a graph showing the results of measurement of the relative noise field intensity in an experiment conducted on an embodiment of the present invention.

FIG. 3 shows, by way of example, the results of measurement of the noise field intensity to prove the effect of ferrite when used as one or both of the electrodes 3 and 10. In FIG. 3, the vertical axis represents the relative noise field intensity in dB, and the horizontal axis represents the noise frequency in MHz. The noise field intensity was measured by a circuit shown in FIG. 4. In the measurement, current supplied from a battery 14 to an ignition coil 15 was interrupted by a switch 16 to generate a high-voltage pulse across the secondary winding of the ignition coil 15. This pulse was applied to the rotor electrode 10 of the distributor. The rotor shaft was rotated to cause discharge across the rotor electrode 10 and one of the side electrodes 3. A detecting resistor 19 was connected between the side electrodes 3 and ground to form part of a closed loop which conducted the discharge current to the grounded end of the secondary winding of the ignition coil 15. The voltage appearing across the detecting resistor 19 was applied to a tunable type of noise field intensity measuring instrument 20 to be read on the instrument 20. In the circuit shown in FIG. 4, the rotor shaft was rotated at a constant speed of 1,500 rpm, the detecting resistor 19 was a non-inductive resistor of 50 Ω, and the noise field intensity measuring instrument 20 was a commercially available model NF-105 made by Singer Company. The vertical axis of FIG. 3 represents the difference between the readings of the measuring instrument for the prior art electrode structure and those of the measuring instrument for the electrode structure of the present invention at various noise frequencies. In the prior art electrode structure, brass was used for both of the rotor electrode and the side electrodes. The dotted line A represents the reading for the brass electrodes, and the noise field intensity in this case is set at 0 dB to show the relative noise field intensity levels represented by the solid curves B, C and D. The curve B represents the relative noise field intensity when the rotor electrodes of aluminum and the side electrodes of ferrite were used, and the curve C represents that when the rotor electrode of ferrite and the side electrodes of aluminum were used, while the curve D represents that when the rotor electrode of ferrite and the side electrodes of also ferrite were used. It can be seen from FIG. 3 that employment of the rotor electrode of ferrite or the side electrodes of ferrite exhibits a satisfactory radio noise suppression effect, and this effect becomes more marked when both the rotor electrode of ferrite and the side electrodes of ferrite are employed.

Figure 5A:
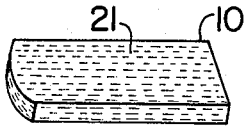
FIGS. 5*a* to 5*d* are schematic perspective views of electrodes used in an experiment conducted for verifying the effectiveness of the basic principle illustrated in FIG. 2.
Figure 5B:
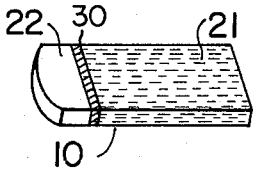
Figure 5C:
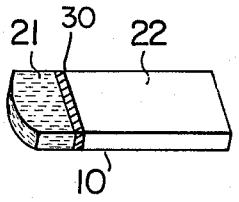
Figure 5D:
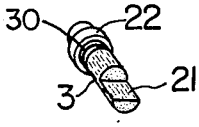
Figure 6:
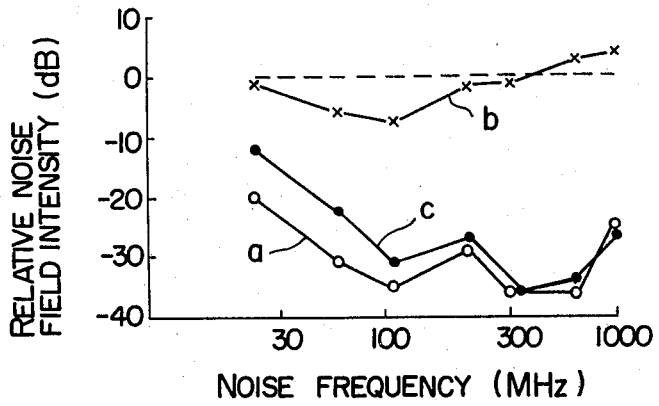
FIG. 6 is a graph showing the results of measurement of the relative noise filed intensity in the experiment using the electrodes shown in FIG. 5.

Generally, the ferrite has a resistance, and this resistive component exhibits a filter effect against a high-frequency current. It has been a common practice to split the rotor electrode into halves along the current flowing direction and insert a resistor between the halves for the expectation of this filter effect. It has been clarified from an experiment shown in FIG. 5 that the radio noise suppression effect of the present invention owes principally to the aforementioned space charge effect instead of the prior art simple filter effect owing to the insertion of the resistor. In this experiment, three kinds of rotor electrodes were prepared. One of the rotor electrodes was in the form of a single bar 21 of ferrite as shown in FIG. 5*a*. In another rotor electrode, brass 22 was bonded by a conductive paint to one end, that is, the discharge-participating area of a single bar 21 of ferrite to cover about 1/5 of the entire length of the ferrite bar 21 as shown in FIG. 5*b*. In the third rotor electrode, ferrite 21 was bonded by a conductive paint to the discharge-participating area of a single bar 22 of brass to cover about 1/5 of the entire length of the brass bar 22 as shown in FIG. 5*c*. FIG. 6 shows the results of measurement of the relative noise field intensity for the distributors including these three kinds of rotor electrodes and the side electrodes of brass. In FIG. 6, the curves a, b and c correspond to FIGS. 5*a*, 5*b* and 5*c* respectively. It can be seen from FIG. 6 that the rotor electrode having at least its discharge-participating area covered with ferrite as shown in FIG. 5*c* exhibits a marked radio noise suppression effect, not to say of the rotor electrode of ferrite shown in FIG. 5*a*, and the rotor electrode utilizing the resistivity of ferrite as shown in FIG. 5*b* does not exhibit any substantial radio noise suppression effect. Thus, the positive function of the aforementioned space charge effect was verified.

The rotor electrode shown in FIG. 5*c* is covered with the ferrite 21 at its discharge-participating area, and the brass 22 which is a conductive material constitutes the body portion engaged by the center electrode. Thus, this rotor electrode has both the advantage of good radiation of heat and the advantage of high resistance against wear. A rotor electrode in a distributor is heated by the heat developed during discharge and thus tends to be thermally deteriorated at its portion supported integrally by the rotor head. The rotor electrode structure shown in FIG. 5*c* can satisfactorily radiate heat and can thus obviate the problem pointed out above. The problem of wear need not be taken into consideration since the body portion of the rotor electrode shown in FIG. 5*c* is made of the conventional material such as brass. From another point of view, the rotor electrode shown in FIG. 5*c* has a high resistance against wear at this specific portion. A side electrode shown in FIG. 5*d* is similar to the rotor electrode shown in FIG. 5*c* in that its discharge-participating area is covered with ferrite 21 and its body portion connected with the cable is made of brass 22. In lieu of the brass shown in FIGS. 5*c* and 5*d*, aluminum may be used as described with reference to FIG. 3 to achieve the same effect.

It will thus be understood that employment of an electrode having its discharge-participating area finely divided into interspersed conductive regions and high-resistance regions is effective in greatly reducing the discharge voltage due to the occurrence of pre-ignition prior to the main discharge. The limit of the resistance value of such high-resistance regions of the electrode will now be discussed.

Suppose now that the high-resistance films have a volume resistivity $\rho$ and a dielectric constant $\epsilon s$. The rate of decay of charges accumulating on the high-resistance films is generally expressed by a time constant $\tau$ as follows:

$$\tau = \epsilon o \cdot \epsilon s \cdot \rho \quad (1)$$

where $\epsilon o$ is the dielectric constant in vacuum and is $8.85 \times 10^{-10}$ F/cm. The time constant $\tau$ represents the time at which the accumulating charges are decreased to about 40% (more accurately, 1/e (=2.718)), and this value is a determinative factor of attainment of the radio noise suppression effect.

In the distributor shown in FIG. 1, the discharge time interval t of the rotor electrode is given by $$t = 60/NP \quad (2)$$

where P is the number of side electrodes, that is, the number of cylinders of the internal combustion engine, and N is the rpm of the rotor shaft.

From the equations (1) and (2), the relation $$\tau > 60/NP \quad (3)$$

must hold so that more than 40% of the charges can remain on the high-resistance films. The number P of engine cylinders is, for example, four, six or eight. The discharge time interval t is shortened with the increase in P, and less decay occurs in the charges. Thus, setting the value of P at P=4 will be sufficient for the present discussion. For the same reason, the value of N may be its minimum and is set herein at N=300 which is the rpm of the rotor shaft during idling.

Thus, the relation (3) can be expressed as $$\tau > 60/(4 \times 300) = 5 \times 10^{-2} \text{ sec}$$

It is therefore required that the time constant $\tau = \epsilon o \cdot \epsilon s \cdot \rho$ of the high-resistance films be set at a value larger than $5 \times 10^{-2}$ sec.

Assuming that the dielectric constant $\epsilon s = 4$, the volume resistivity $\rho$ of the high-resistance films is given by $$\rho > 1.4 \times 10^{9} \ \Omega\text{-cm}$$

Since, generally, the dielectric constant of an inorganic solid high-resistance layer lies within the range of 4 to 40, the above value may be taken down one place to provide the order of $10^8$ Ω-cm as far as the present discussion is concerned. The upper limit of the volume resistivity of the high-resistance films is not affected by the value of the time constant, and the notable effect of the present invention extends to the infinitely greatest value of the volume resistivity.

While the above discussion has referred to the decay of charges on the rotor electrode, the same applies to the side electrode when the value of P in the equation (3) is set at P=1. In the case of the side electrode of the same material as the rotor electrode, the time constant is larger than the aforementioned value, and the desired effect can be sufficiently achieved when the restricting conditions on the rotor electrode are satisfied.

Embodiment 2

Figure 7:
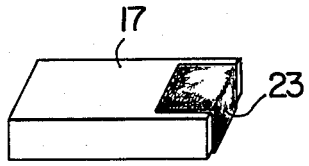
FIG. 7 is a schematic perspective view of an electrode employed in another embodiment of the present invention.
Figure 8:
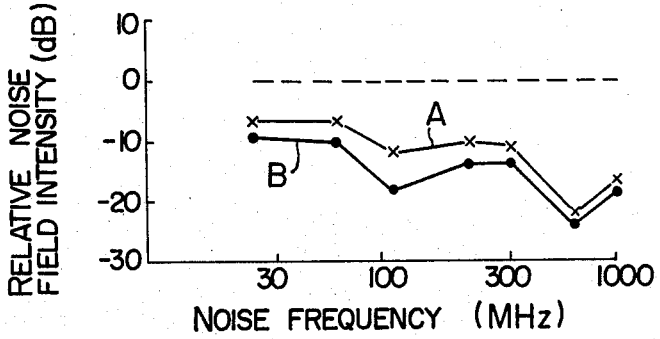
FIG. 8 is a graph showing the results of measurement of the relative noise field intensity when the electrode shown in FIG. 7 was used.

FIG. 7 shows a rotor electrode of aluminum 17 which is covered at its discharge-participating area with a woven or non-woven fabric 23 of inorganic material such as glass. In conjunction with this rotor electrode, side electrodes of aluminum were prepared, and the relative noise field intensity was measured by the circuit shown in FIG. 4. The results are shown in FIG. 8, and the manner of display of the results of measurement is as described with reference to FIG. 3. In FIG. 8, the curve A represents the relative noise field intensity when the woven or non-woven fabric 23 of glass had a thickness of 0.11 mm and an apparent density of 0.21 g/cm$^3$, and the curve B represents that when the woven or non-woven fabric 23 of glass had a thickness of 0.24 mm and an apparent density of 0.24 g/cm$^3$. It can be seen from FIG. 8 that the relative noise field intensity can be reduced by about 20 dB compared with the prior art electrode structure. Such a radio noise suppression effect can be obtained due to the fact that space charges accumulating on the surface of the glass which is an insulator are discharged, that is, pre-ignition occurs prior to the main discharge.

Embodiment 3

Figure 9A:
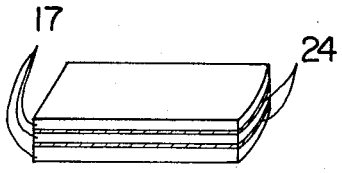
FIGS. 9*a* and 9*b* are schematic perspective views of electrodes employed in still another embodiment of the present invention.
Figure 9B:
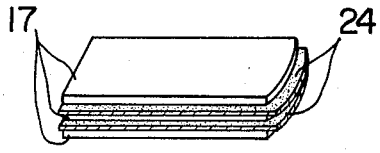
Figure 10:
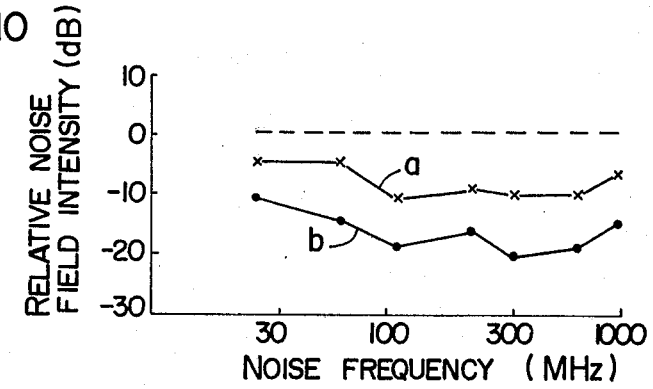
FIG. 10 is a graph showing the results of measurement of the relative noise field intensity when the electrodes shown in FIGS. 9*a* and 9*b* were used.

Two mica sheets 24 each having a thickness of 0.1 mm were sandwiched between three aluminum sheets 17 each having a thickness of 0.5 mm and were bonded at their engaging surfaces to the aluminum sheets 17 by an epoxy resin type adhesive to constitute two rotor electrodes as shown in FIG. 9. In the rotor electrode shown in FIG. 9*a*, the mica sheets 24 and the aluminum sheets 17 were flush at the discharge-participating area of the rotor electrode. In the rotor electrode shown in FIG. 9*b*, the mica sheets 24 protruded by about 0.2 mm from the aluminum sheets 17 at the discharge-participating area of the rotor electrode. FIG. 10 shows the results of measurement of the relative noise field intensity on the combinations of these rotor electrodes and the side electrodes of brass. In FIG. 10, the curves a and b correspond to FIGS. 9*a* and 9*b* respectively, and it can be seen from FIG. 10 that the noise field intensity can also be reduced by about 10 to 20 dB compared with the prior art electrode structure.

In this case too, the heat radiation effect and the wear resistance effect can be improved when the body portion of the rotor electrode engaged by the center electrode is made of a conductor as shown in FIG. 5*c*, and the discharge-participating area is constructed in the form of a laminate of aluminum sheets and mica sheets. In addition to the rotor electrode, the side electrodes may also be in the form of a laminate of aluminum sheets and mica sheets. It is to be understood that the materials constituting the laminate are in no way limited to aluminum and mica, and any other suitable metallic and inorganic materials may be used.

Embodiment 4

Figure 11:
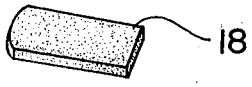
FIG. 11 is a schematic perspective view of an electrode employed in yet another embodiment of the present invention.

Powders of metals or carbon were mixed with powders of metal oxides, and the mixtures were sintered to obtain a plurality of sintered rotor electrodes 18 each having a shape as shown in FIG. 11. The mixture were as follows:

Sample A: Powdery tungsten and powdery $Al_2O_3$ were thoroughly mixed at a volume ratio of 1:1, and the mixture was put into a mold and hot-pressed at a temperature of 1,500° C. under a pressure of 500 kg/cm$^2$ to prepare the rotor electrode.

Sample B: 70% by volume of powdery copper was thoroughly mixed with 30% by volume of $SiO_2$, and the mixture was hot-pressed at a temperature of 900° C. under a pressure of 2,000 kg/cm$^2$ to prepare the rotor electrode.

Sample C: 80% by volume of powdery aluminum was thoroughly mixed with 20% by volume of MgO, and the mixture was hot-pressed at a temperature of 550° C. under a pressure of 2,000 kg/cm$^2$ to prepare the rotor electrode.

Sample D: 50% by volume of powdery copper was thoroughly mixed with 50% by volume of powdery borosilicate glass, and a suitable amount of polyvinyl alcohol was then added to the mixture. After granulating the mixture, the granules were shaped into the form of the rotor electrode and sintered at a temperature of 900° C. in a nitrogen gas atmosphere to prepare the rotor electrode.

Sample E: 10% by volume of powdery carbon was thoroughly mixed with 90% by volume of borosilicate glass, and the mixture was shaped into the rotor electrode according to the same process at that used for the preparation of the sample D.

Figure 4:
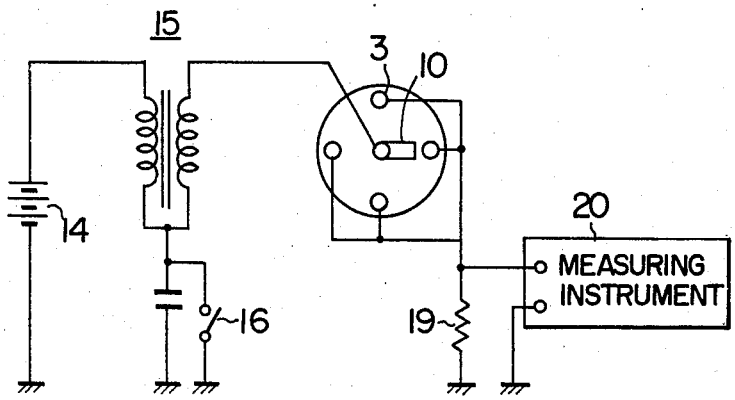
FIG. 4 is a circuit diagram of the circuit used for the measurement of the relative noise field intensity.
Figure 12:
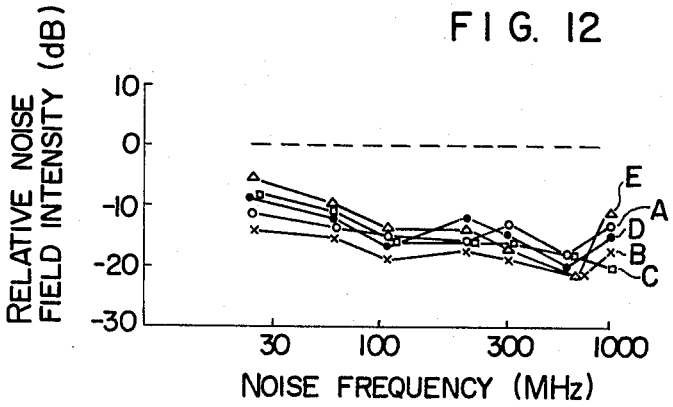
FIG. 12 is a graph showing the results of measurement of the relative noise field intensity when the electrode shown in FIG. 11 was used.

The rotor electrode samples A to E thus obtained were combined with side electrodes of brass, and the circuit shown in FIG. 4 was used to measure the relative noise field intensity. FIG. 12 shows the results of measurement. It can be seen from FIG. 12 that the relative noise field intensity can be reduced by about 10 to 20 dB in each sample although the radio noise suppression effect varies slightly depending on the samples.

It was confirmed by observation with an electron microscope that the marked radio noise suppression effect can be derived from the distribution of conductive fine particles and resistive fine particles in the discharge-participating area of the rotor electrode. While the present embodiment has referred to the rotor electrodes of various materials, similar materials may be used in the side electrodes too to enhance the radio noise suppression effect as described with reference to FIG. 3.

It will be understood from the foregoing detailed description of preferred embodiments of the present invention that the high-frequency current appearing from a distributor can be effectively suppressed by the unique electrode structure according to the present invention, and yet the electrodes can be formed from inexpensive electrode materials. The conventional electrodes can be easily replaced by the electrodes of the present invention without accompanying any modification in the structure of existing distributors.

What we claim is:

1. A distributor for an internal combustion engine comprising center electrode means, rotor electrode means, side electrode means disposed opposite to said rotor electrode means with a discharge gap defined therebetween, and means for distributing high-voltage pulses generated by an ignition coil to individual ignition plugs through said center electrode means, said rotor electrode means and said side electrode means, wherein at least one of said rotor electrode means and said side electrode means has its discharge-participating area formed from only ferrite, whereby said high-voltage pulses generated by said ignition coil are distributed to said side electrode means which establishes a main-ignition preceded by a pre-ignition which occurs on the surface of said ferrite.

2. A distributor as claimed in claim 1, wherein at least one of said rotor electrode means and said side electrode means is formed from ferrite.

3. A distributor as claimed in claim 1, wherein said rotor electrode means has an electrode structure in which its discharge-participating area is formed from ferrite, and its area engaged by said center electrode means is formed from a conductive metal material.

4. A distributor as claimed in claim 3, wherein said conductive metal material is one of aluminum and brass.

5. A distributor as claimed in claim 1, wherein said side electrode means has an electrode structure in which its discharge-participating area is formed from ferrite and its area connected to a cable leading to an associated ignition plug is formed from conductive metal.

6. A distributor as claimed in claim 5, wherein said conductive metal material is one of aluminum and brass.

* * * * *